US006152752A

United States Patent [19]

Fukuda

[11] Patent Number: 6,152,752

[45] Date of Patent: Nov. 28, 2000

[54] WATERPROOF CONNECTOR AND METHOD FOR ASSEMBLING SAME

[75] Inventor: Masaru Fukuda, Shizuoka-ken, Japan

[73] Assignee: Yazaki Corporation, Tokyo, Japan

[21] Appl. No.: 09/421,276

[22] Filed: Oct. 20, 1999

[30] Foreign Application Priority Data

Oct. 20, 1998 [JP] Japan ..... 10-298746

[51] Int. Cl.[7] ..... H01R 13/40; H01R 13/52; H01R 13/514

[52] U.S. Cl. ..... 439/275; 439/586; 439/587; 439/274; 439/752; 439/598

[58] Field of Search ..... 439/588, 587, 439/589, 274, 275, 586, 752, 752.5, 598, 599, 271

[56] References Cited

U.S. PATENT DOCUMENTS

| | | | |
|---|---|---|---|
| 4,681,691 | 7/1987 | Schriver, Jr. | 508/100 |
| 4,702,710 | 10/1987 | Dittman et al. | 439/271 |
| 4,973,268 | 11/1990 | Smith et al. | 439/595 |
| 5,470,248 | 11/1995 | Wood | 439/281 |
| 5,613,868 | 3/1997 | Ohsumi et al. | 439/275 |
| 5,720,629 | 2/1998 | Self, Jr. et al. | 439/587 |
| 5,980,317 | 11/1999 | McNeel | 439/589 |

FOREIGN PATENT DOCUMENTS

| | | |
|---|---|---|
| 4-49479 | 4/1992 | Japan . |
| 5-17958 | 3/1993 | Japan . |
| 10-60096 | 3/1998 | Japan . |

*Primary Examiner*—Paula Bradley
*Assistant Examiner*—Edwin A. León
*Attorney, Agent, or Firm*—Finnegan, Henderson, Farabow, Garrett & Dunner, L.L.P.

[57] ABSTRACT

A waterproof connector has an inner housing, in which a plurality of terminal housing chambers are formed for the housing of individual terminals at the ends of wires, and an outer housing, into which the inner housing is fitted, in which wire insertion holes are formed on a wall that opposes the terminal housing chambers, and further in which is formed rubber cover housing depressions that house a rubber waterproofing cover that seals the inside of the terminal housing chambers, in positions that are opposite each wire insertion hole on the inside of the wall. The rubber waterproofing cover is formed by a plurality of individual rubber cover pieces that are held in intimate contact inside the rubber cover housing depressions, and a holding plate part with which the individual rubber waterproofing cover pieces are integrally formed, which is held between the inner housing and the outer housing, and which makes a seal between the rubber cover housing depressions and the terminal housing chambers.

4 Claims, 3 Drawing Sheets

WATERPROOF CONNECTOR AND METHOD FOR ASSEMBLING SAME

BACKGROUND OF THE INVENTION

1. Field of the Invention

The present invention relates to a compact, multipin, waterproof connector with improved waterproofing between a connector housing and a plurality of leads connected to terminals, and to a method for assembly such as waterproof connector.

2. Description of the Related Art

In a waterproof connector, a plurality of waterproof covers 18 are each inserted into waterproof cover housing depressions. In such a waterproof connector, however, when the connector has a large number of pins, the number of waterproof covers also becomes large, and the task of inserting each of the waterproof covers into the waterproof cover housing depressions becomes arduous, requiring a large amount of time.

Additionally, there is the problem that if there is even one location into which a cover is inadvertently not inserted, water can intrude through that part, thereby destroying the watertight integrity of the overall connector.

Accordingly, it is an object of the present invention to provide a waterproof connector that simplifies the task of inserting the rubber waterproofing covers, enabling insertion in a short amount time, and that also prevents inadvertent missing covers, and to provide a method for assembling such a waterproof connector.

SUMMARY OF THE INVENTION

To achieve the above-noted object, a first aspect of the present invention is a waterproof connector that has an inner housing, in which a plurality of terminal housing chambers are formed for the housing of individual terminals at the ends of wires, and an outer housing, into which the inner housing is fitted, in which wire insertion holes are formed on a wall that opposes the terminal housing chambers, and further in which is formed rubber cover housing depressions that house a rubber waterproofing cover that seals the inside of the terminal housing chambers, in positions that are opposite each wire insertion hole on the inside of the wall. The rubber waterproofing cover is formed by a plurality of individual rubber cover pieces that are held in intimate contact inside the rubber cover housing depressions, and a holding plate part with which the individual rubber waterproofing cover pieces are integrally formed, which is held between the inner and the outer housing, and which makes a seal between the rubber cover housing depression and the terminal housing chamber.

In the present invention, the holding plate part is inserted into the outer housing with wires inserted through the individual rubber waterproofing cover pieces of the rubber waterproofing cover. By performing this insertion, the individual rubber waterproofing covers are housed in the rubber cover housing depressions that correspond thereto, so that intimate contact is made with the rubber cover housing depressions. Then, by holding the holding plate part between the outer housing and the inner housing, the overall rubber waterproofing cover is fixed in place, so that the individual rubber waterproofing cover pieces cannot be pulled out of the rubber cover housing depressions, thereby establishing watertight integrity.

In the present invention, because a plurality of individual rubber waterproofing cover pieces that are housed in the rubber cover housing depressions are formed integrally with the holding plate part, by inserting the holding plate part into the outer housing, it is possible to insert all of the plurality of individual rubber waterproofing cover pieces into the rubber cover housing depressions simultaneously. It is not, therefore, necessary to make separate insertions into the rubber cover housing depressions, thereby simplifying and speeding up the task of insertion.

Additionally, because the individual rubber waterproofing cover pieces are formed integrally with the holding plate part, by setting the holding plate part in place, the individual rubber waterproofing cover pieces are reliably inserted into the rubber cover housing depressions. For this reason, there is no chance that one will forget to insert a cover, thereby enabling the establishment of watertight integrity.

Because the holding plate part is held between the inner housing and the outer housing, so that a seal is achieved between the rubber waterproofing cover depression parts and the inner housing terminal housing chambers, it is possible to reliably prevent the intrusion of water into the terminal housing chambers. For this reason, there is an improvement in waterproofing.

The second aspect of the present invention is a variation on the first aspect, wherein a spacer, into which is fitted the inner housing, is inserted between the inner housing and the outer housing, the holding plate part being held between this spacer and peripheral edge of the aperture on the terminal housing chamber side of the rubber cover housing depressions.

Because the inner housing is fitted into the spacer in the second aspect, the terminals within the inner housing are prevented from being pulled out. By inserting this spacer between the outer housing and the inner housing, the holding plate part of the rubber waterproofing cover is held between the spacer and the outer housing, thereby holding the rubber waterproofing cover in place. For this reason, it is not necessary to have a dedicated part for preventing the pull-out of the rubber waterproofing cover, thereby enabling a reduction in the number of parts, and simplifying the structure.

The third aspect of the present invention is a variation on either the first or the second aspect thereof, wherein the individual rubber cover pieces have an inner ribbed part and an outer ribbed part.

Because of the inner ribbed part and the outer ribbed part, the individual rubber cover pieces have shape with protrusions and depressions, so that there is alternation between parts that make contact with and parts that do not make contact with the wire. For this reason, it is possible to prevent the intrusion of water by capillary action, thereby improving the waterproofing effectiveness.

The fourth aspect of the present invention is a method for assembling a waterproof connector that has an inner housing, in which a plurality of terminal housing chambers are formed for the housing of individual terminals of at the ends of wires, and an outer housing, into which the inner housing is fitted, in which wire insertion holes are formed on a wall that opposes the terminal housing chambers, and further in which is formed rubber cover housing depressions that house a rubber waterproofing cover that seals the inside of the terminal housing chambers, in positions that are opposite each wire insertion hole on the inside of the wall, this method of assembly having a step of inserting the rubber waterproofing cover, in which are integrally formed a plurality of individual rubber cover pieces and a holding plate part, into the outer housing, and housing the plurality of individual rubber covers pieces in each of the rubber cover housing depressions of the outer housing, a subsequent step of fitting the inner housing into the outer housing, so that the holding plate part of the rubber waterproofing cover is held between the inner housing and the outer housing.

In the above-noted method of assembly according to the present invention, by inserting the holding plate part into the inner housing and housing the individual rubber cover pieces, which are integrally formed with the holding plate part in the rubber cover housing depressions, it is possible in a single action to house the individual rubber cover pieces into the rubber cover housing depressions, thereby simplifying and quickening the task of insertion, while preventing the inadvertent missing of insertions.

DESCRIPTION OF THE PREFERRED EMBODIMENTS

Preferred embodiments of the present invention are described below, with reference being made to relevant accompanying drawings.

Figure 1:
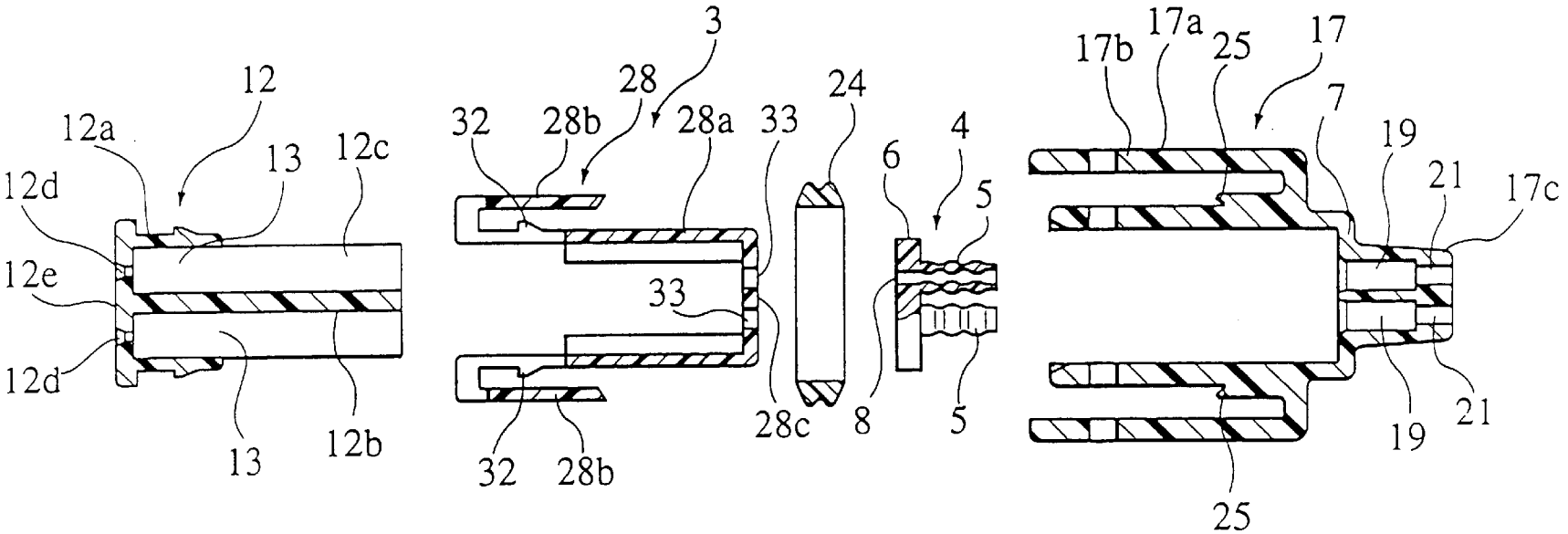
FIG. 1 is an exploded perspective view of an embodiment of a waterproof connector according to the present invention.
Figure 2:
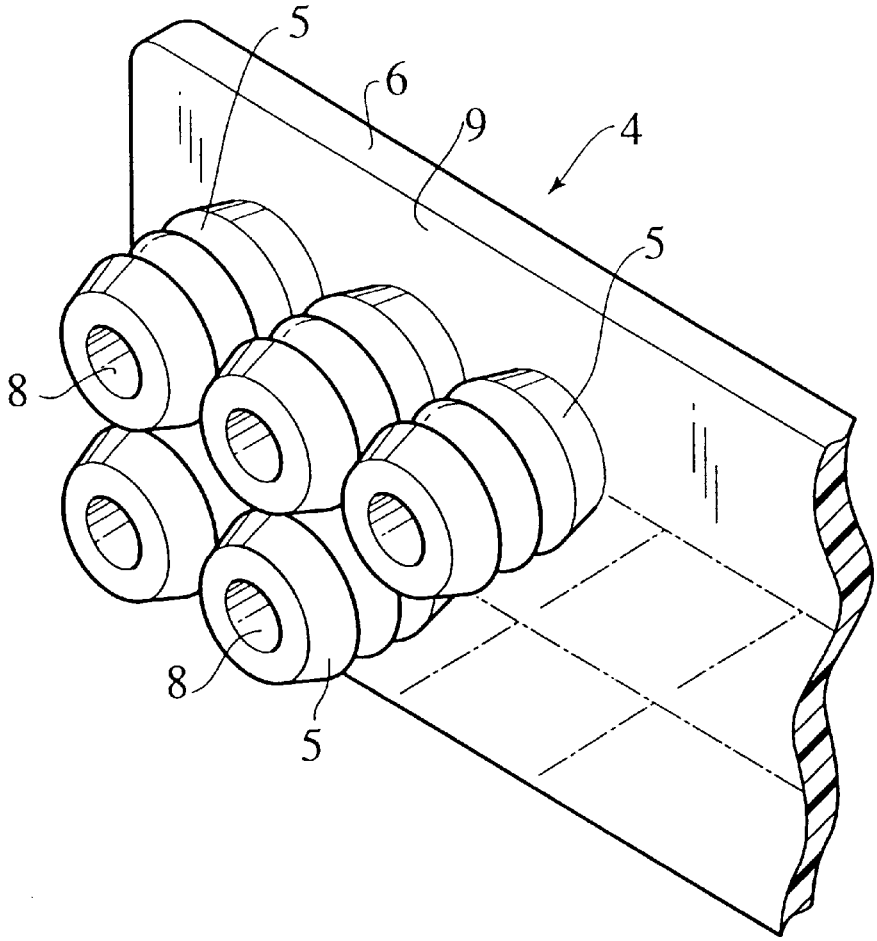
FIG. 2 is a perspective view of a rubber waterproofing cover.
Figure 3:
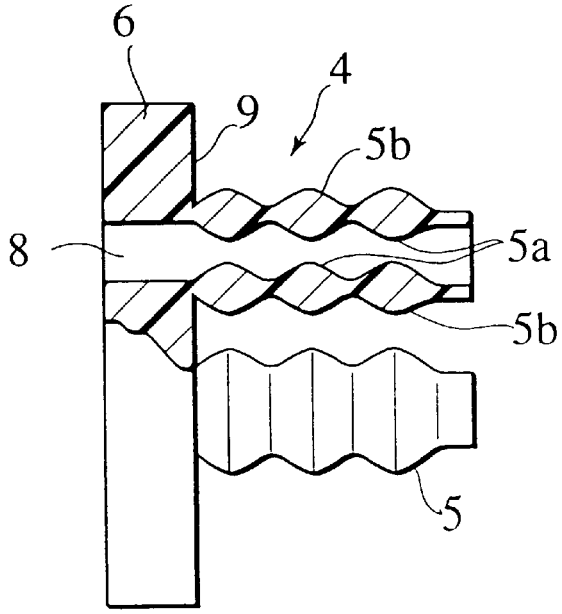
FIG. 3 is a partially broken side view of the rubber waterproofing cover.
Figure 4:
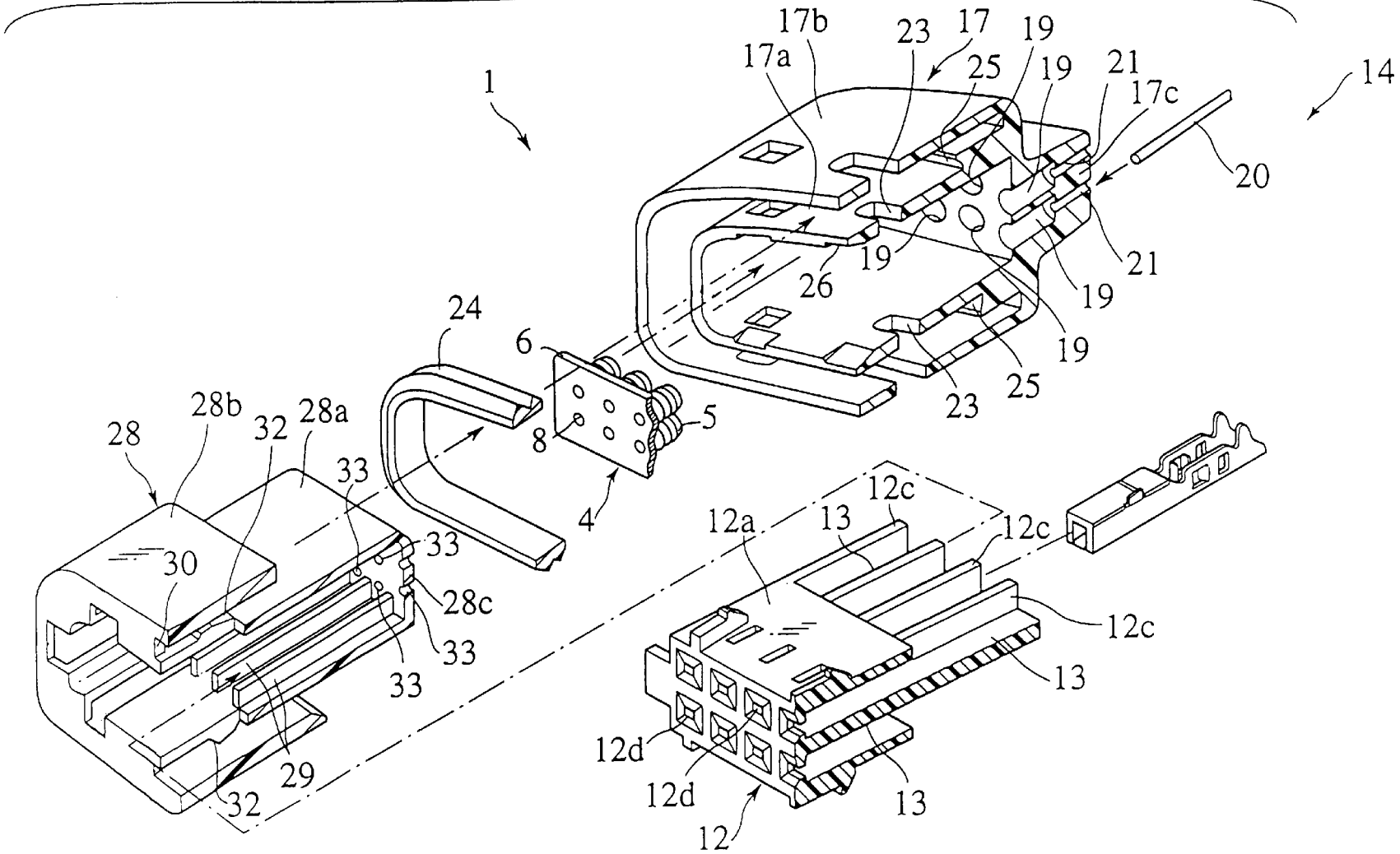
FIG. 4 is an exploded perspective view of a waterproof connector.

FIG. 1 is an exploded perspective view of an embodiment of the present invention, and FIG. 2 and FIG. 3 are a perspective view and partially broken side view of a rubber waterproofing cover, in which elements that are the same as shown in FIG. 4 are assigned the same reference numeral.

As shown in FIG. 1, the connector housing 3 of this waterproof connector 1 embodiment of the present invention has a inner housing 12 having a plurality of terminal housing chambers 13, an outer housing 17, into which the inner housing 12 is fitted, and a spacer 28 inserted between the inner housing 12 and the outer housing 17. The inner housing 12, the outer housing 17, and the spacer 28 are formed from synthetic resin.

The terminal housing chambers 13 of the inner housing 12 house female terminals 14 (shown in FIG. 4). These terminal housing chambers 13 are formed in a space that is formed by a front wall 12*e* of a box part 12*a* in which is formed insertion holes 12*d* through which male terminals of a mating connector are inserted, a central horizontal wall 12*b*, and a vertical side wall 12*c*, which serves also as a divider.

The spacer 28 has formed in it wire insertion holes 33, through which wires 20 (shown in FIG. 4) to the ends of which are connected the female terminals 14. These wire insertion holes 33 are formed on the bottom wall part (one wall) 28*c* that links the body 28*a* and the jaw 28*b* of the spacer 28 to the outer housing on the mating side. The body 28*a* of the spacer 28 is fitted into the inner surface of the inner wall part 17*a* of the outer housing 17, and the jaw 28*b* of the spacer 28 is fitted onto the outer surface side of the inner wall 17*a* of the outer housing 17.

The outer housing 17 is of a double-box construction, having an internal wall part 17*a* that is substantially a rectangular prism, and an outer wall part 17*b* that surrounds the inner wall part 17*a* and is substantially a rectangular prism, the inner wall part 17*a* and the outer wall part 17*b* being linked via the bottom wall part (one wall) 17*c*. At positions on this bottom wall 17*c* which are oppose the wire housing chambers 13, there are formed wire insertion holes 21, through which wires are passes.

Each of the wire insertion holes 21 communicates with a large-diameter rubber cover housing depression 19. The inner wall part 17*a* sides of the rubber cover housing depressions 19 are open, the individual rubber cover pieces 5 of the rubber waterproofing cover 4 to be described below being inserted from these openings, so that the individual rubber cover pieces 5 are housed therein. The area around the openings of the rubber cover housing depressions 19 is a formed as a wide aperture rim 7, the inner wall part 17*a* and the outer wall part 17*b* being joined by the aperture rim 7. The holding plate part 6, of the rubber waterproofing cover 4, to be described below, makes contact with this aperture rim 7.

As shown in FIG. 2 and FIG. 3, the rubber waterproofing cover 4 has a planar holding plate part 6 and a plurality of individual rubber cover pieces 5, which are formed integrally with the holding plate part 6 and protrude upright therefrom, the overall rubber waterproofing cover 4 being formed from an insulating rubber material, The holding plate part 6 and the individual rubber cover pieces 5 have formed in them through holes through which wires are passed.

The plurality of rubber cover pieces 5 are each in opposition to one of a plurality of rubber cover housing depressions 19 that are formed in the outer housing 17, and are each housed within the opposing rubber cover housing depression 19. For this reason, the number of individual rubber cover pieces is the same as the number of rubber cover housing depressions 19, and each of the individual rubber cover pieces 5 is provided in a position that is opposite a rubber cover housing depression 19.

By forming a plurality of inner ribs 5*a* that protrude toward the inside of the wire insertion hole of each individual rubber cover piece 5 and a plurality of outer ribs 5*b* that protrude to the outside on the outside of each individual rubber cover piece 5, a pattern of protrusions and depressions is formed on the inner and outside surfaces of the individual rubber cover pieces 5. By forming such a pattern, there is alternation between parts that make contact with and parts that do not make contact with the wire that is inserted through the wire insertion hole 8. For this reason, even if water should intrude into the contact part, capillary action will be cutoff at the non-contact part, thereby preventing water from further intruding, and providing an improvement in waterproofing effectiveness.

The holding plate part 6 of the rubber waterproofing cover 4 has a grasping flange 9 that extends further to the outside than the positions at which the individual rubber cover pieces are formed. This grasping flange 9 makes contact wit the aperture rim 7 of the outer housing and, in this condition of contact, the spacer 28 is inserted into the outer housing 17, the result being that the grasping flange 9 is held between the spacer 28 and the aperture rim 7.

The holding plate part 6 according to this embodiment is formed so as to have substantially the same length and width as the inner wall part 17*a*, the grasping flange 9 being held being the bottom wall part 28*c* of the spacer 28 and the aperture rim 7, so that all the rubber cover housing depressions 19 are covered. By doing this, the holding plate part 6 completely divides and seals the rubber cover housing depressions 19 from the terminal housing chambers 13 of the inner housing 12.

In the case of assembling the above-noted embodiment of a waterproof connector 1, the packing material 24 is priorly inserted into the package receptacle part 25 of the inner wall part 17*a* of the outer housing 17 that forms the outside of the connector housing 3. In this condition, wires are inserted from outside through each wire insertion hole 21 of the bottom wall part 17*c* of the outer housing 17. Then, the wires that have been passed through the holes are passed through each individual rubber cover piece 5, so as to pass through the wire insertion holes 8 of the rubber waterproofing cover 4.

Next, the rubber waterproofing cover 4 is inserted into the inner wall part 17*c* of the outer housing 17. This insertion is done from the individual rubber cover piece 5 side and causes contact of the holding plate part 6 with the aperture rim 7. The plurality of individual rubber cover pieces 5 are integrally formed with the holding plate part 6 and, as a result on contact with the aperture rim 7 of the holding plate part 6, all the individual rubber cover parts 5 are inserted simultaneously into and housed in corresponding rubber cover housing depressions 19. Therefore, it is not necessary to separately insert individual rubber waterproofing cover each into a rubber cover housing depression 19, thereby simplifying and shortening the time required for the assembly of the rubber waterproofing cover 4.

After the above is done, the end of each wire 20 is passed through a wire insertion hole 33, and made to come into contact with a pair of pressure blades of a female terminal 14 that is housed in the terminal housing chamber 13 of the inner housing 12, thereby achieving a contact with the wire. Then, as each wire is caused to slide with respect to the bottom wall part 28*c* of the spacer and the wire insertion holes 33 and 21 of the bottom wall part 17*c* of the outer housing 17, the inner housing 12 is fitted completely into the inside of the body part 28*a* of the spacer 28. By making this fit, the mating tongues 32 of the spacer 28 mate with the mating holes 23 (show in FIG. 4) that are formed on the inner wall part 17*a* of the outer housing 17, the mating tongues 15 of the inner housing 12 also mating with the mating holes 23 of the inner wall part 17*a* of the outer housing 17.

By the above-noted mating action, the bottom wall part 28*c* of the spacer 28 and the aperture rim 7 of the outer housing 17 cause the holding plate part 6 of the rubber waterproofing cover 4 to be held in the inserted condition, so that the individual rubber cover pieces 5 cannot be pulled out of the rubber cover housing depressions 19. Therefore, the individual rubber cover pieces 5 assemble the waterproof connector 1, within which wires are sealed. When this is done, the holding plate part 4 of the rubber waterproofing cover 4 cuts off and seals the terminal housing chambers 13 of the inner housing from the rubber cover housing depressions 19 of the outer housing 17.

In an embodiment as described above, by mounting a holding plate part in an outer housing 17, it is possible to insert all the individual rubber cover pieces 5 simultaneously into the rubber cover housing depressions 19, thereby eliminating the work involved in inserting the individual rubber cover pieces into the rubber cover housing depressions separately, which simplifies the insertion task and shortens the amount of time it requires.

Additionally, because the individual rubber cover parts 5 are integrally formed with the holding plate part 6, by mounting the holding plate part 6, individual rubber cover pieces 5 are reliably inserted into corresponding rubber cover housing depressions 19, thereby eliminating inadvertently omitted insertions and achieving good waterproofing.

Additionally, because the rubber waterproofing cover 4 is held in place by holding the holding plate part 6 between the spacer 28 and the aperture rim 7 of the outer housing, it is not necessary to provide a dedicated part to prevent pull-out of the rubber waterproofing cover 4, thereby reducing the number of parts and simplifying the structure.

By having the holding plate part 6 of the rubber waterproofing cover 4 held between the spacer 28 and the aperture rim 7 of the outer housing 17, the effect is that the holding plate part 6 provides separation between the rubber cover housing depressions 19 and the terminal housing chambers 13 of the inner housing 12. For this reason, it is possible to seal the terminal housing chambers 13, thereby reliably preventing the intrusion of water into the terminal housing chambers 13.

Additionally, because of the individual rubber cover parts 5 are provided with a plurality of inner ribs 5*a* and outer ribs 5*b*, a pattern of protrusions and depressions is formed on the inner and outer surfaces thereof, so that even capillary action results in the intrusion of water, because this capillary action is cut off, there is an improvement in waterproofing.

Additionally, it will be understood that various forms of the present invention other than the one described in the above embodiment are possible. For example, rather than using a spacer 28, it is possible to fit the inner housing 12 directly into the outer housing 17. It is further possible, in addition using terminals that make a connection with a wire by means of pressure contact, to use a crimp-on type terminal.

As described in detail above, according to the present invention as recited in claim one of the attached claims, because a plurality of individual rubber waterproofing cover pieces that are housed in the rubber cover housing depressions are formed integrally with the holding plate part, by inserting the holding plate part into the outer housing, it is possible to insert all of the plurality of individual rubber waterproofing cover pieces into the rubber cover housing depressions simultaneously. It is not, therefore, necessary to make separate insertions into the rubber cover housing depressions, thereby simplifying and speeding up the task of insertion. In addition, because the individual rubber waterproofing cover pieces are formed integrally with the holding plate part, by setting the holding plate part in place, the individual rubber waterproofing cover pieces are reliably inserted into the rubber cover housing depressions. For this reason, there is no chance that one will forget to insert a cover, thereby enabling the establishment of watertight integrity.

According to the present invention as recited in claim 2 of the attached claims, because the holding plate part of the rubber waterproofing cover is held between the spacer and the outer housing, thereby holding the rubber waterproofing cover in place. For this reason, it is not necessary to have a dedicated part for preventing the pull-out of the rubber waterproofing cover, thereby enabling a reduction in the number of parts, and simplifying the structure.

According to the present invention as recited in claim 3 of the attached claims, because of the inner ribbed part and the outer ribbed part of the individual rubber cover pieces, it is possible to prevent the intrusion of water by capillary action, thereby improving the waterproofing effectiveness.

According to the present invention as recited in claim 4 of the attached claims, by inserting the holding plate part into the inner housing and housing the individual rubber cover pieces in the rubber cover housing depressions, it is possible in a single action to house the individual rubber cover pieces into the rubber cover housing depressions, thereby simplifying and quickening the task of insertion, while preventing the inadvertent missing of insertions.

What is claimed is:

1. A waterproof connector comprising:

an inner housing having a plurality of terminal housing chambers for housing individual terminals at the ends of wires;

an outer housing engageable with the inner housing, the outer housing having a wall opposing the terminal housing chamber, the wall having wire insertion holes, the outer housing having rubber cover housing depressions between the wall and the inner housing; and a rubber waterproofing cover having a plurality of individual rubber cover pieces and a holding plate part, the individual rubber waterproofing cover pieces integrally formed with the holding plate part, the rubber waterproofing cover pieces held in intimate contact inside the rubber cover housing depressions, the holding plate part held between the inner and the outer housings to make a seal between the rubber cover housing depression and the terminal housing chamber.

2. A waterproof connector according to claim 1, further comprising a spacer disposed between the inner housing and the outer housing, wherein the inner housing is fitted into the spacer, the holding plate held between the spacer and a rim of an aperture on a terminal housing chamber side of the rubber cover housing depressions.

3. A waterproof connector according to claim 1, wherein the individual rubber cover pieces have an inner ribbed part and an outer ribbed part.

4. A method for assembling a waterproof connector including an inner housing, an outer housing and a robber waterproofing cover, the inner housing having a plurality of terminal housing chambers for housing individual terminals at the ends of wires, the outer housing engageable with the inner housing, the outer housing having a wall opposing the terminal housing chamber, the wall having wire insertion holes, the outer housing having rubber cover housing depressions between the wall and the inner housing, the rubber waterproofing cover having a plurality of individual rubber cover pieces and a holding plate part, the individual rubber waterproofing cover pieces integrally formed with the holding plate, the method of assembly comprising:

inserting the rubber waterproofing cover into the outer housing, and housing the plurality of individual rubber cover pieces in each of the rubber cover housing depressions so as to form intimate contact; and fitting the inner housing into the outer housing, so that the holding plate part of the rubber waterproofing cover is held between the inner housing and the outer housing, the holding plate part thereby forming a seal between the rubber cover housing depressions and the terminal housing chambers.

* * * * *